US007914358B2

(12) United States Patent
Wei et al.

(10) Patent No.: US 7,914,358 B2
(45) **Date of Patent: *Mar. 29, 2011**

(54) METHOD FOR MANUFACTURING FIELD EMISSION ELECTRON SOURCE HAVING CARBON NANOTUBES

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 247 days.

This patent is subject to a terminal disclaimer.

(21) Appl. No.: 12/313,937

(22) Filed: Nov. 26, 2008

(65) Prior Publication Data

US 2009/0239439 A1 Sep. 24, 2009

(30) Foreign Application Priority Data

Mar. 19, 2008 (CN) ..... 2008 1 0066127

(51) Int. Cl.
*H01J 9/00* (2006.01)

(52) U.S. Cl. ..... 445/49; 445/50; 445/51; 423/447.1

(58) Field of Classification Search ..... 445/49–51; 423/447.1

See application file for complete search history.

(56) References Cited

U.S. PATENT DOCUMENTS 6,504,292 B1 1/2003 Choi et al.
7,064,474 B2 6/2006 Liu et al.
2003/0143356 A1 7/2003 Morikawa
2003/0186625 A1* 10/2003 Nakayama et al. ..... 451/28
2006/0065887 A1 3/2006 Tiano et al.
2007/0284987 A1 12/2007 Liu et al.
2009/0115306 A1 5/2009 Wei et al.
2009/0117674 A1 5/2009 Wei et al.
2009/0117808 A1 5/2009 Wei et al.
2009/0239072 A1* 9/2009 Wei et al. ..... 428/402

FOREIGN PATENT DOCUMENTS

CN 1433039 A 7/2003
CN 101042977 A 9/2007

OTHER PUBLICATIONS

Fan shou-shan et al., "Explorations in growth mechanism, controlled synthesis and applications of carbon nanotubes", Physics,vol. 35, issue:5, pp. 376-381,2006.

Jiang Kai-Li et al., "Continuous carbon nanotube yarns and their applications",Physics,vol. 32, issue:8, pp. 506-510, 2003.

* cited by examiner

*Primary Examiner* — Mariceli Santiago
(74) *Attorney, Agent, or Firm* — D. Austin Bonderer

(57) ABSTRACT

A method for manufacturing a field emission electron source includes: (a) Providing a carbon nanotube (CNT) film, the CNT film has a plurality of CNTs, the CNTs are aligned along a same direction; a first electrode and a second electrode. (b) Fixing the two opposite sides of the CNT film on the first electrode and the second electrode, the CNTs in the CNT film extending from the first electrode to the second electrode. (c) Treating the CNT film with an organic solvent to form at least one CNT string. (d) Applying a voltage between two opposite ends of the CNT string until the CNT string snaps, thereby at least one CNT needle, the CNT needle has an end portion and a broken end portion. (e) Securing the CNT needle to a conductive base by attaching the end portion of the CNT needle to the conductive base.

20 Claims, 15 Drawing Sheets

METHOD FOR MANUFACTURING FIELD EMISSION ELECTRON SOURCE HAVING CARBON NANOTUBES

RELATED APPLICATIONS

This application is related to commonly-assigned applications entitled, "FIELD EMISSION ELECTRON SOURCE HAVING CARBON NANOTUBES", filed Nov. 26, 2008; "CARBON NANOTUBES NEEDLE AND METHODE FOR MAKING THE SAME", filed Nov. 26, 2008; "ELECTRON EMISSION APPARATUS", filed Nov. 26, 2008; "ELECTRON EMISSION APPARATUS AND METHOD FOR MAKING THE SAME", filed Nov. 26, 2008. The disclosure of the respective above-identified application is incorporated herein by reference.

BACKGROUND

1. Field of the Invention

The invention relates to a method for manufacturing a field emission electron source employing carbon nanotubes.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios greater than 1000), and a tip-surface area near the theoretical limit (the smaller the tip-surface area, the more concentrated the electric field, and the greater the field enhancement factor). These features tend to make CNTs ideal candidates for field emission electron sources.

Generally, a field emission electron source having CNTs includes a conductive base, along with CNTs formed thereon. The CNTs acts as an emitter of the field emission electron source. The methods adopted for forming the CNTs on the conductive base mainly include mechanical methods and in situ synthesis methods. The mechanical method is performed by respectively placing a single CNT on a conductive base by an atomic force microscope (AFM), subsequently fixing the CNT on the conductive base by conductive or non-conductive adhesives. However, the controllability of the mechanical method is not as desirable because a single CNT is too small in size.

The in situ synthesis method is performed by coating metal catalysts on a conductive base and synthesizing CNTs on the conductive base directly by means of chemical vapor deposition (CVD). However, since the direction of the CNTs cannot be controlled, it is difficult to get a regular field emission electron source.

What is needed, therefore, is a controllable and simple method for manufacturing a field emission source with high field emission efficiency.

SUMMARY

In one embodiment, a method for manufacturing a field emission electron source, the method comprising the steps of: (a) providing a carbon nanotube (CNT) film comprising of a plurality of CNTs, the CNTs being aligned along a same direction, a first electrode, and a second electrode; (b) fixing the two opposite sides of the CNT film on the first electrode and the second electrode, the CNTs in the CNT film extending from the first electrode to the second electrode; (c) treating the CNT film with an organic solvent to form at least one CNT string; (d) applying a voltage between two opposite ends of the CNT string until the CNT string snaps, thereby obtaining at least one CNT needle, wherein the CNT needle has an end portion and a broken end portion; and (e) securing the CNT needle to a conductive base by attaching the end portion of the at least one CNT needle to the conductive base; and wherein the broken end portion has a single tip CNT protruding from the broken end portion.

Compared to conventional technologies, the method for making the field emission electron source has the following advantages: firstly, since the CNT needle has a larger scale than the CNT, the present method for making the field emission electron source using the CNT needle as the electron emitter is more controllable and simple. Furthermore, the electric and thermal conductivity, and mechanical strength of the CNT string are improved in the process for making the field emission electron source. Therefore, the field emission efficiency of the field emission electron source is improved.

Other advantages and novel features of the present method for manufacturing a field emission source will become more apparent from the following detailed description of exemplary embodiments when taken in conjunction with the accompanying drawings.

BRIEF DESCRIPTION OF THE DRAWINGS

Many aspects of the present method for manufacturing a field emission source can be better understood with references to the following drawings. The components in the drawings are not necessarily drawn to scale, the emphasis instead being placed upon clearly illustrating the principles of the present method for manufacturing a field emission electron source.

Figure 1:
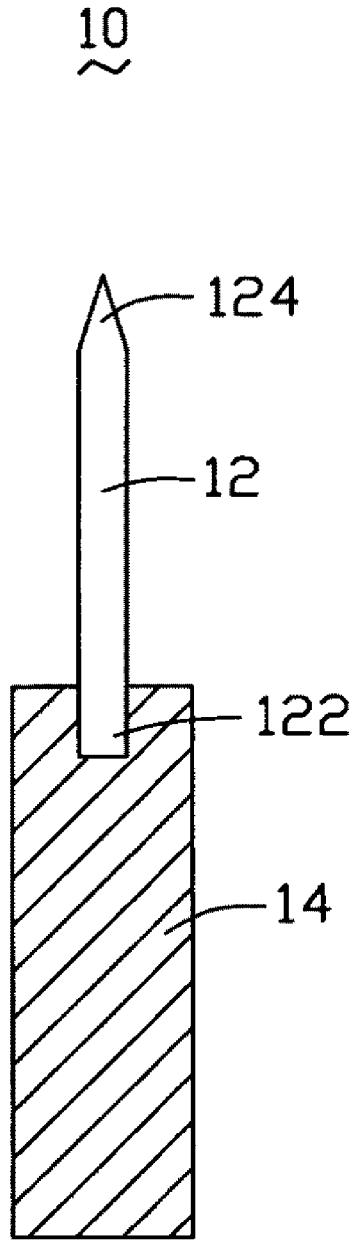
FIG. 1 is a schematic, cross-sectional view, showing a field emission electron source manufactured by the present method.

Corresponding reference characters indicate corresponding parts throughout the several views. The exemplifications set out herein illustrate at least one preferred embodiment of the present method for manufacturing a field emission electron source, in one form, and such exemplifications are not to be construed as limiting the scope of the invention in any manner.

DETAILED DESCRIPTION OF EXEMPLARY EMBODIMENTS

References will now be made to the drawings to describe the exemplary embodiments of the present method for manufacturing a field emission electron source, in detail.

Referring to FIG. 1, a field emission electron source 10 includes a CNT needle 12 and a conductive base 14. The CNT needle 12 includes an end portion 122 and a broken end portion 124. The end portion 122 of the CNT needle 12 is in contact with and electrically connected to a surface of the conductive base 14. An angle between a longitudinal axis of the CNT needle 12 with the surface of the conductive base 14 is from 0 to 90 degrees.

Figure 2:
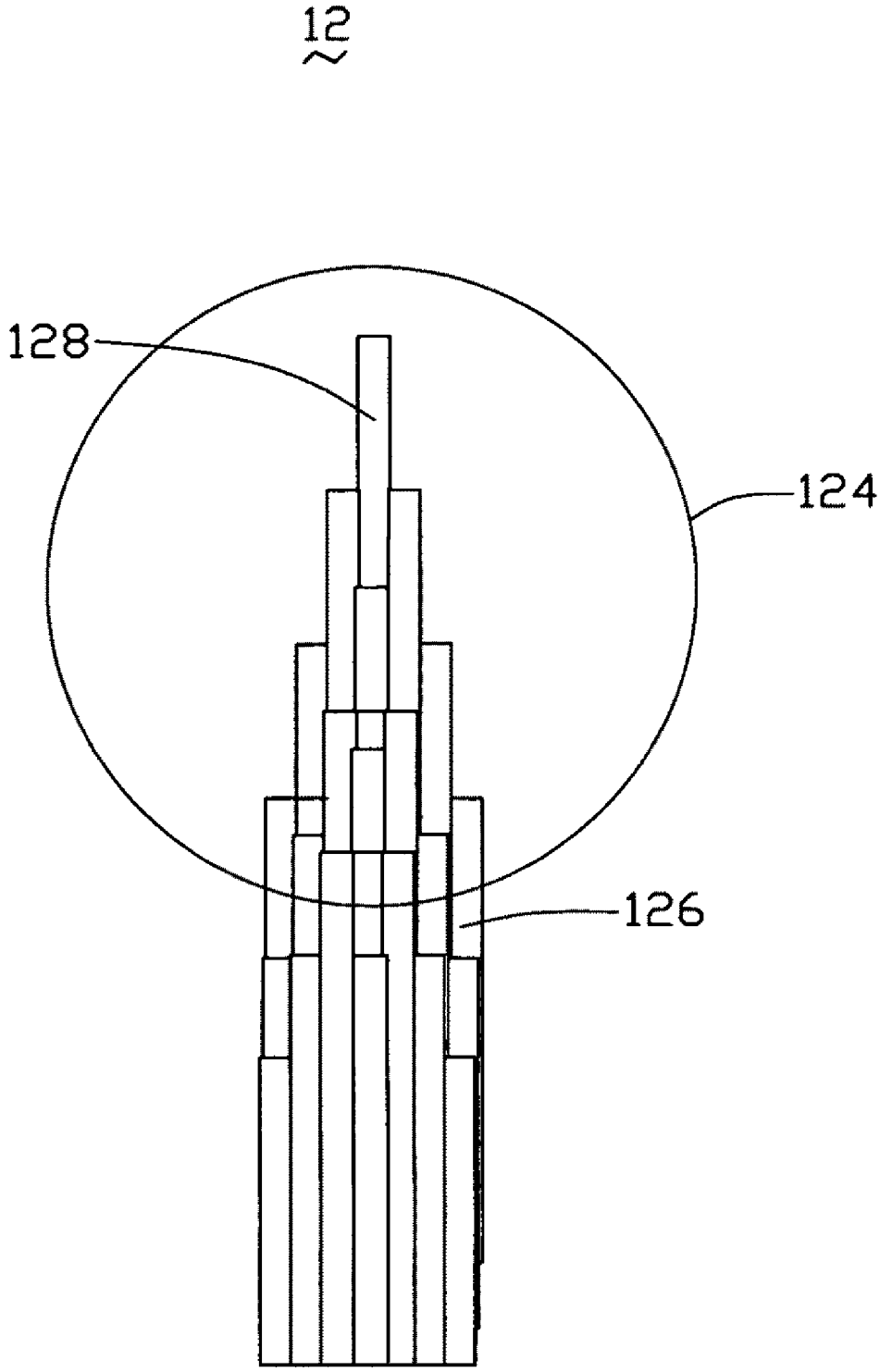
FIG. 2 is a schematic, cross-sectional view, showing a carbon nanotube needle manufactured by the present method.
Figure 3:
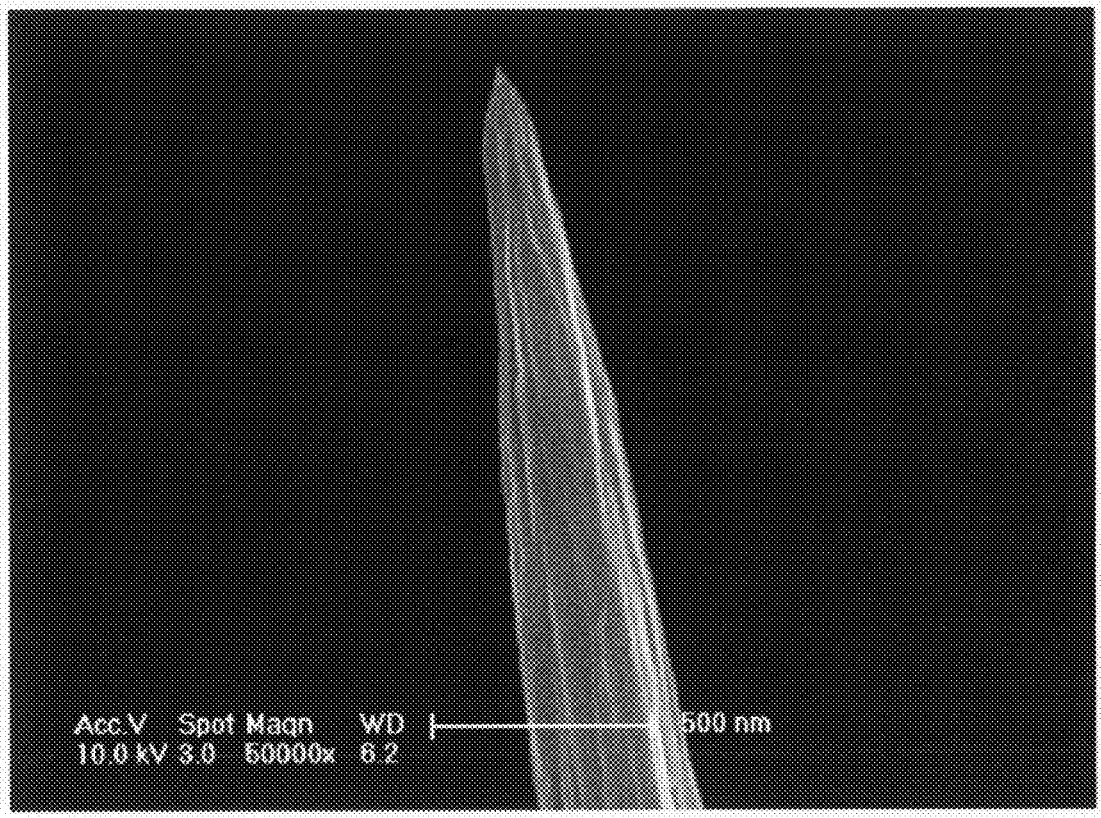
FIG. 3 shows a Scanning Electron Microscope (SEM) image of a carbon nanotube needle manufactured by the present method.
Figure 4:
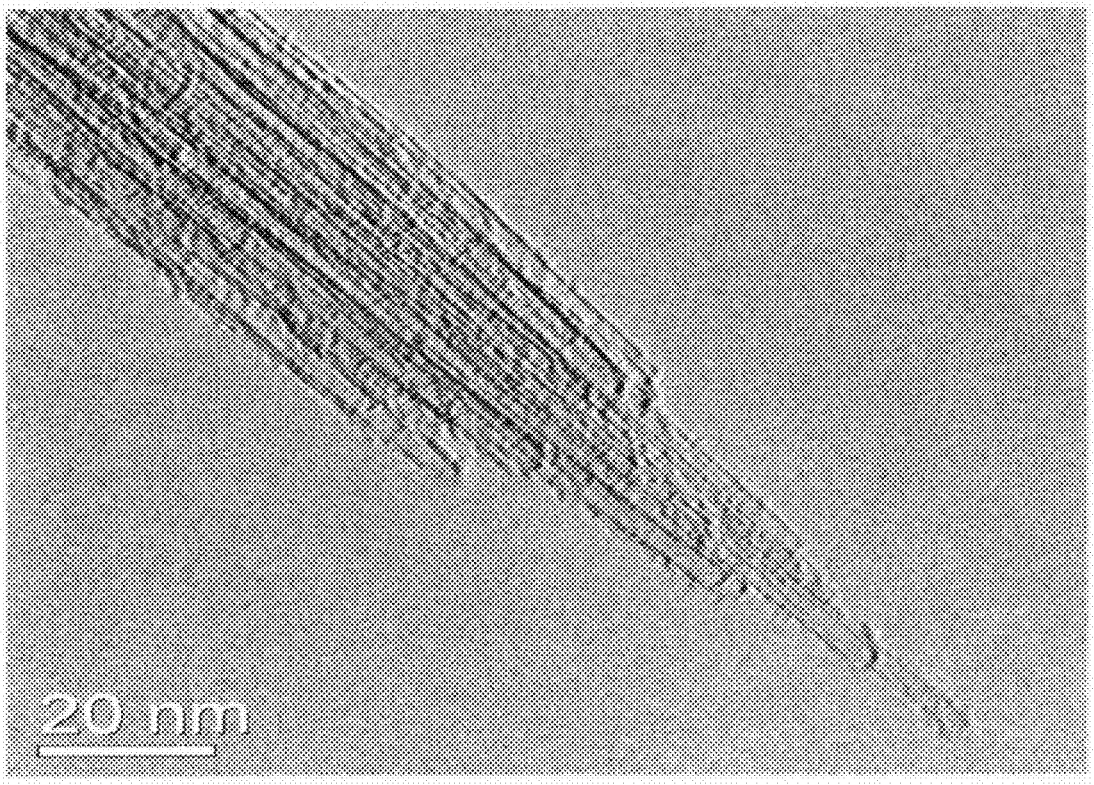
FIG. 4 shows a Transmission Electron Microscope (TEM) image of a carbon nanotube needle manufactured by the present method.

The CNT needle 12 is a CNT bundle. Each carbon nanotube bundle includes a plurality of continuously oriented and substantially parallel carbon nanotubes joined end-to-end by van der Waals attractive force. A diameter of the CNT needle 12 approximately ranges from 1 to 20 microns (μm), and a length thereof ranges from 0.01 to 1 millimeters (mm). Referring to FIGS. 2, 3 and 4, the CNTs at the broken end portion 124 form a similar taper-shaped structure, i.e., one CNT protruding and higher than the adjacent CNTs. The CNTs at the broken end portion 124 have smaller diameters and a fewer number of walls, typically, less than 5 nanometers (nm) in diameter and have approximately 2-3 walls. However, the CNTs in the CNT needle 12 other than the broken end portion 124 are about 15 nm in diameter and have more than 5 walls. The conductive base 14 is made of an electrically conductive material, such as nickel, copper, tungsten, gold, molybdenum or platinum. The conductive base 14 can also be an insulated base with a conductive film formed thereon.

Figure 5:
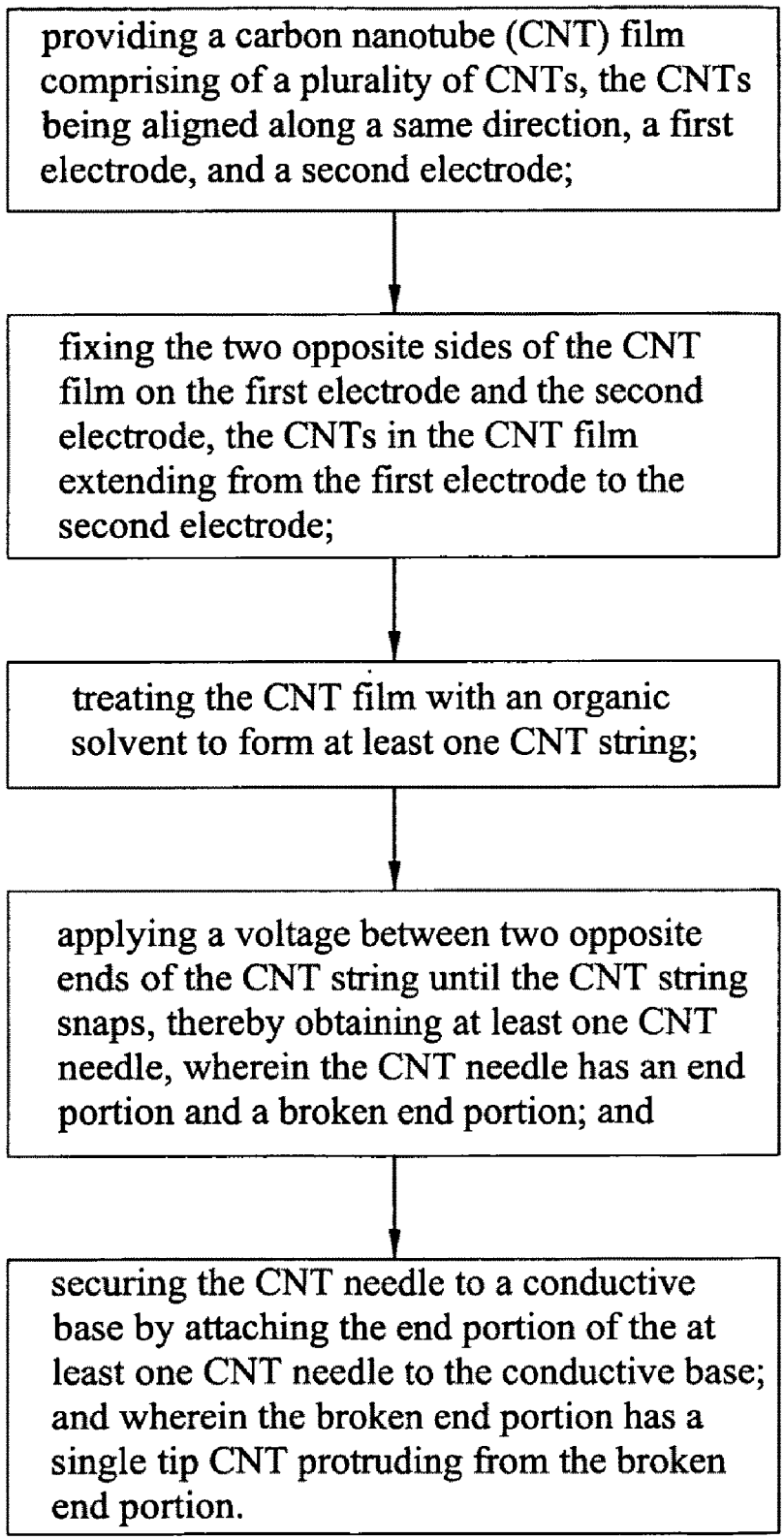
FIG. 5 is a flow chart of a method for manufacturing a field emission source employing CNTs, in accordance with a present embodiment.

Referring to FIG. 5, a method for manufacturing the field emission electron source includes the following steps: (a) providing a CNT film having a plurality of CNTs therein, the CNTs being aligned along a same direction; and a first electrode and a second electrode; (b) fixing the two opposite sides of the CNT film on the first electrode and the second electrode, the CNTs in the CNT film extending from the first electrode to the second electrode; (c) treating the CNT film with an organic solvent to form a plurality of CNT strings; (d) applying a voltage between two opposite ends of the CNT string via the first electrode and the second electrode until the CNT string snaps, and thereby at least one CNT needle, wherein the at least one CNT needle has an end portion and a broken end portion; and (e) securing the CNT needle to a conductive base by attaching the end portion of the at least one CNT needle to the conductive base.

In step (a), the CNT film is formed by the following sub-steps: (a1) providing an array of CNTs and a super-aligned array of CNTs; and (a2) drawing a CNT segment from the array of CNTs via a pulling tool to form the CNT film.

In step (a1), initially, a substrate is provided, and the substrate is a P-type silicon or N-type silicon substrate. Secondly, a catalyst layer is deposited on the substrate. The catalyst layer is made of a material selected from a group consisting of iron (Fe), cobalt (Co), nickel (Ni), and their alloys. Thirdly, the substrate with the catalyst layer is annealed at a temperature approximately ranging from 700 to 900 degrees centigrade (° C.) under a protecting gas for approximately 30 minutes to 90 minutes. Fourthly, the substrate with the catalyst layer is heated to a temperature approximately ranging from 500° C. to 740° C. and a mixed gas including a carbon containing gas and a protecting gas is introduced for about 5 to 30 minutes to grow a super-aligned CNTs array. The carbon containing gas is a hydrocarbon gas, such as acetylene or ethane. The protecting gas is an inert gas. The grown CNTs are aligned in columns parallel to each other and are held together by van der Waals force interactions there between. The CNTs array has a high density and each of the CNTs has an essentially uniform diameter.

In step (a2), the CNT segment having a predetermined width includes a plurality of CNTs parallel to each other. The CNT segment is gripped by using an adhesive tape such as the tool to contact the super-aligned array. The pulling direction is substantially perpendicular to the growing direction of the super-aligned array of carbon nanotubes.

In step (a), the first electrode and the second electrode are insulated and separated from each other, wherein a distance between the first electrode and the second electrode ranges from 50 micrometers to 1 millimeter.

Figure 6:
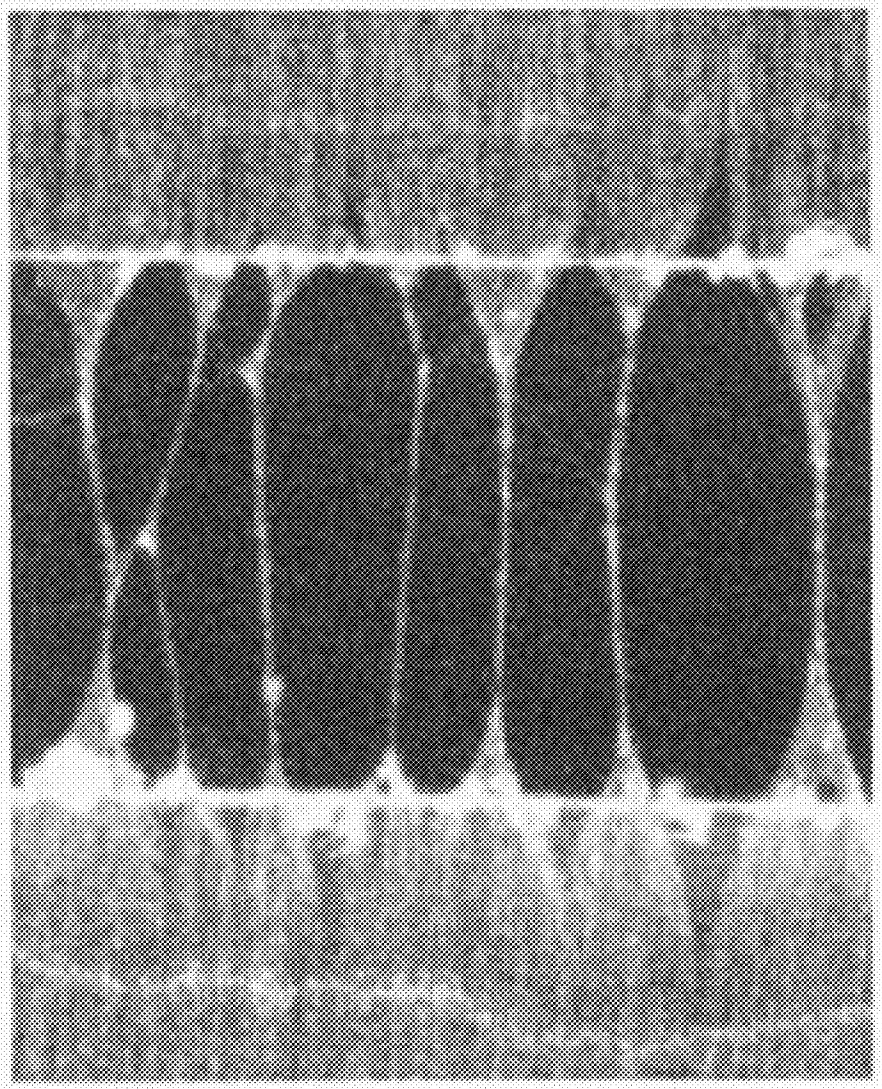
FIG. 6 shows an image of a carbon nanotube film soaked by the organic solvent.

Referring to FIG. 6, step (c) can be executed by dripping the organic solvent onto the CNT film or putting the CNT film with the first electrode and the second electrode in the organic solvent to soak the entire surfaces of the carbon nanotube film. Since the untreated CNT film is composed of a number of the CNTs, the untreated CNT film has a high surface-area-to-volume ratio and thus may easily become stuck to other objects. During the surface treatment, the impending CNT film is shrunk into a plurality of CNT strings after the organic solvent volatilizes due to factors such as surface tension. The surface-area-to-volume ratio and the diameter of the treated CNT string is reduced, while the strength and toughness is improved. The organic solvent may be a volatilizable organic solvent, such as ethanol, methanol, acetone, dichloroethane, chloroform, or any appropriate mixture thereof.

Figure 7:
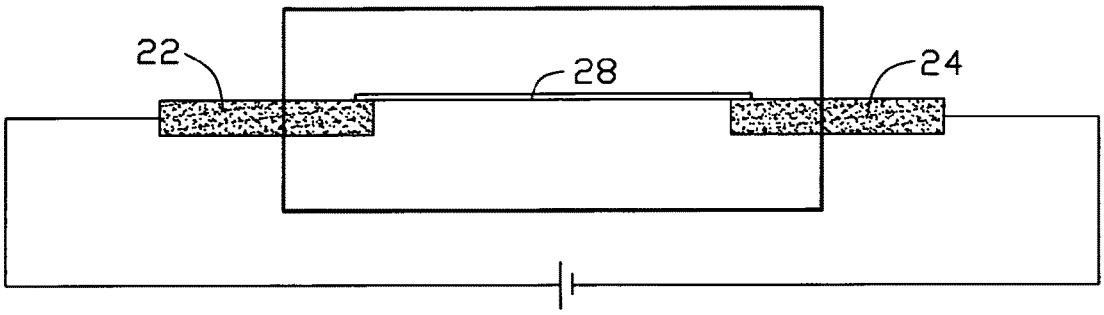
FIG. 7 is a schematic, cross-sectional view, showing the carbon nanotube film of FIG. 6 fusing under a fusing current.
Figure 8:
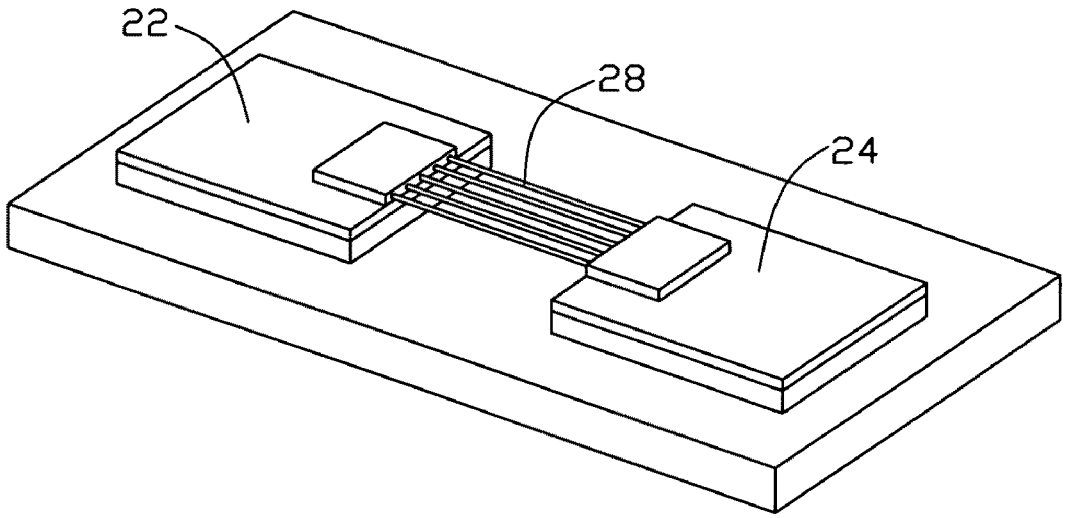
FIG. 8 is a schematic, cross-sectional view, showing a carbon nanotube string.
Figure 9:
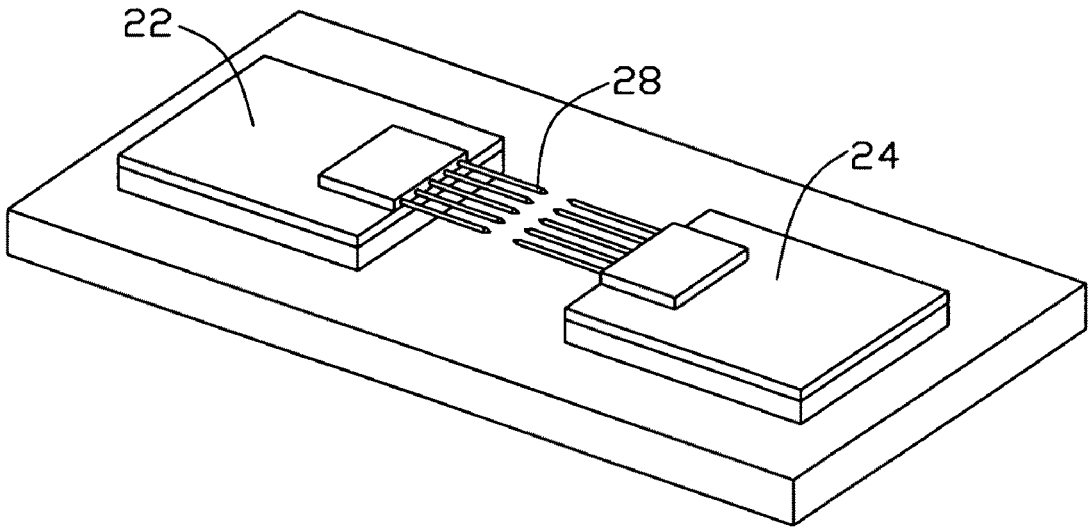
FIG. 9 is a schematic, cross-sectional view, showing the cut carbon nanotube strings.

Referring to FIGS. 7, 8 and 9, the step (d) includes the following sub-steps: (d1) placing the CNT strings, the first electrode 22 and the second electrode 24 in a chamber 20; (d2) applying a voltage between two opposite ends of the CNT strings 28 via the first electrode 22 and the second electrode 24 for a period of time to snap the CNT string 28, thereby acquiring at least one CNT needle 12 with a break-end.

In step (d1), the chamber 20 is a vacuum or filled with an inert gas. A diameter of the CNT string 28 approximately ranges from 1 to 20 micrometers, while a length thereof approximately ranges from 0.05 millimeters to 1 millimeter. In the present embodiment, the vacuum chamber 20 is a vacuum and the pressure thereof is lower than $1\times10^{-1}$ Pascal (Pa).

In step (d2), the voltage can be set according to a diameter and/or a length of the CNT strings 28. In the present embodiment, when a length of the CNT string 28 is 300 μm and a diameter thereof is 2 μm, the voltage is 40 voltage (V). A vacuum of the chamber 20 is less than $2\times10^{-5}$ Pascal (Pa). In the present embodiment, a vacuum of the chamber 20 is $2\times10^{-5}$ Pa.

Figure 10:
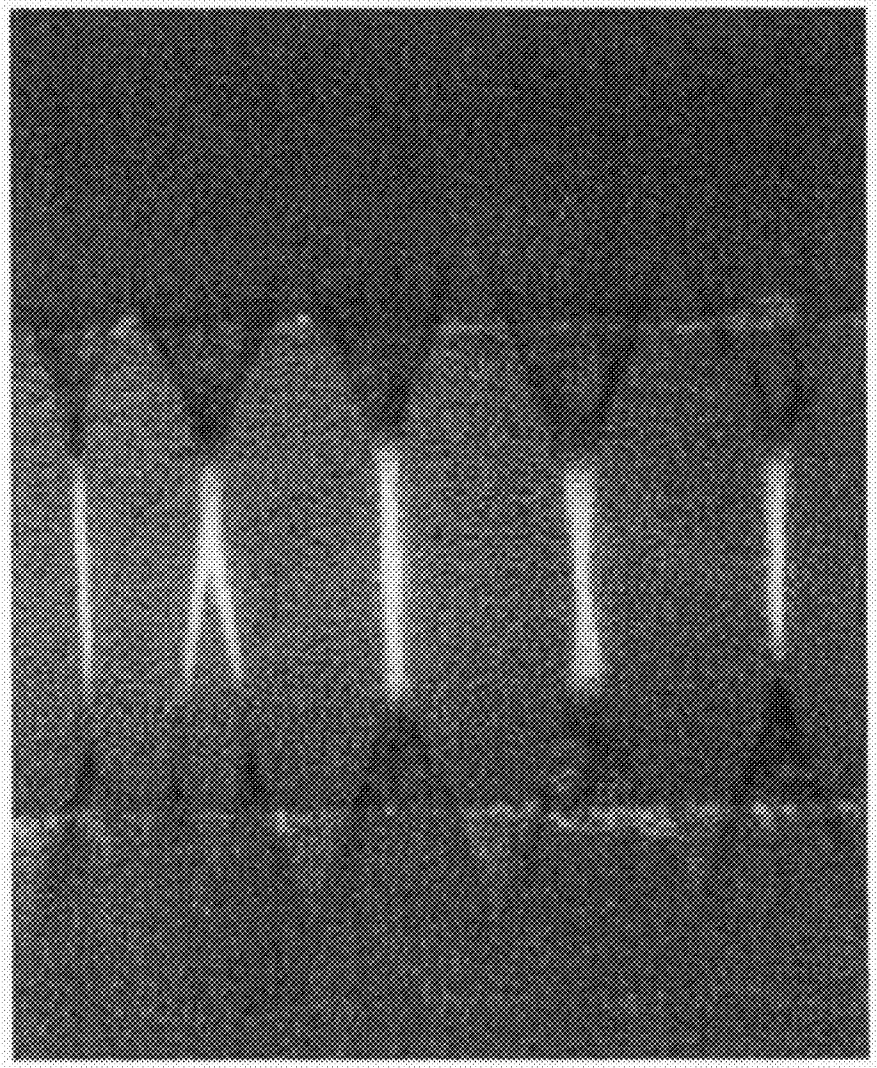
FIG. 10 shows an image of carbon nanotube strings in incandescent state.

Referring to FIG. 10, in step (d2), a temperature of the CNT string 28 increases due to Joule-heating, and the CNT string 28 can reach a temperature approximately ranging from 2000 to 2400 Kelvin (K). When the temperature of the CNT string 28 is high enough, the CNT string 28 is in an incandescent state. Heat in the CNT string 28 is transmitted from the CNT to the electrodes. Since the middle point of the CNT string is furthest away from the electrodes, the temperature thereof is highest, and then the CNT string 28 is broken at the middle point. In the present embodiment, after less than 1 hour (h), the CNT string 28 is snapped at the middle point.

Referring to FIG. 9, after the CNT string 28 breaks/snaps at the middle point, two CNT needles 12 opposite to each other are formed. Each CNT needle 12 includes an end portion and an opposite broken end portion. The end portion is fixed on the first electrode or the second electrode. Each CNT needle 12 is composed of well-aligned and firmly compacted CNTs. Referring to FIGS. 2, 3 and 4, the CNTs at the broken end portion 124 have a taper-shaped structure, i.e., one CNT protrudes and is higher than the adjacent CNTs. That is because during snapping, some carbon atoms vaporize from the CNT string 12. After snapping, a micro-fissure (not labeled) is formed between two break-end portions, the arc discharge may occur between the micro-fissure, and then carbon atoms transform into carbon ions due to ionization. These carbon ions bombard/etch the break-end portions, and then the break-end portion 124 forms the taper-shaped structure.

Figure 11:
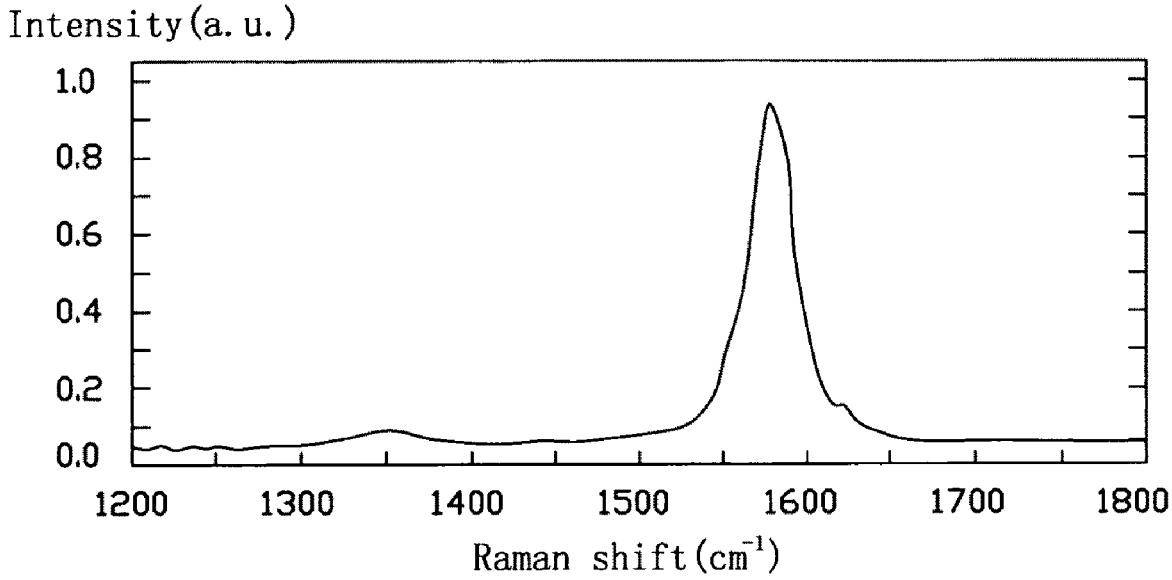
FIG. 11 is a Raman spectrum of the emission tip of the field emission electron source manufactured by the present method.

The CNTs at the broken end portion have smaller diameters and a fewer number of walls, typically, less than 5 nanometers (nm) in diameter and have approximately 2-3 walls. However, the CNTs in the CNT needle 12 other than the break-end portion are about 15 nm in diameter and have more than 5 walls. It is concluded that the diameter and the number of walls of the CNTs are decreased in the vacuum breakdown process. A wall-by-wall breakdown of CNTs is due to Joule-heating at a temperature higher than 2000K, with a current decrease process. The high-temperature process can efficiently remove the defects in CNTs, and consequently improve electric and thermal conductivities, and mechanical strength thereof. FIG. 11 shows a Raman spectrum of the break-end portion 124. After snapping, the intensity of D-band (defect mode) at 1580 $cm^{-1}$ is reduced, which indicates the structure effects at the break-end portion 124 are effectively removed.

The CNT needle 12 has improved field emission efficiency, because of good electric and thermal conductivities and mechanical strength. Moreover, the break-end portion is in the taper-shaped structure, which can prevent the shield effect caused by the adjacent CNTs. Consequently, the field emission efficiency of the CNT needle 12 is further improved.

Figure 12:
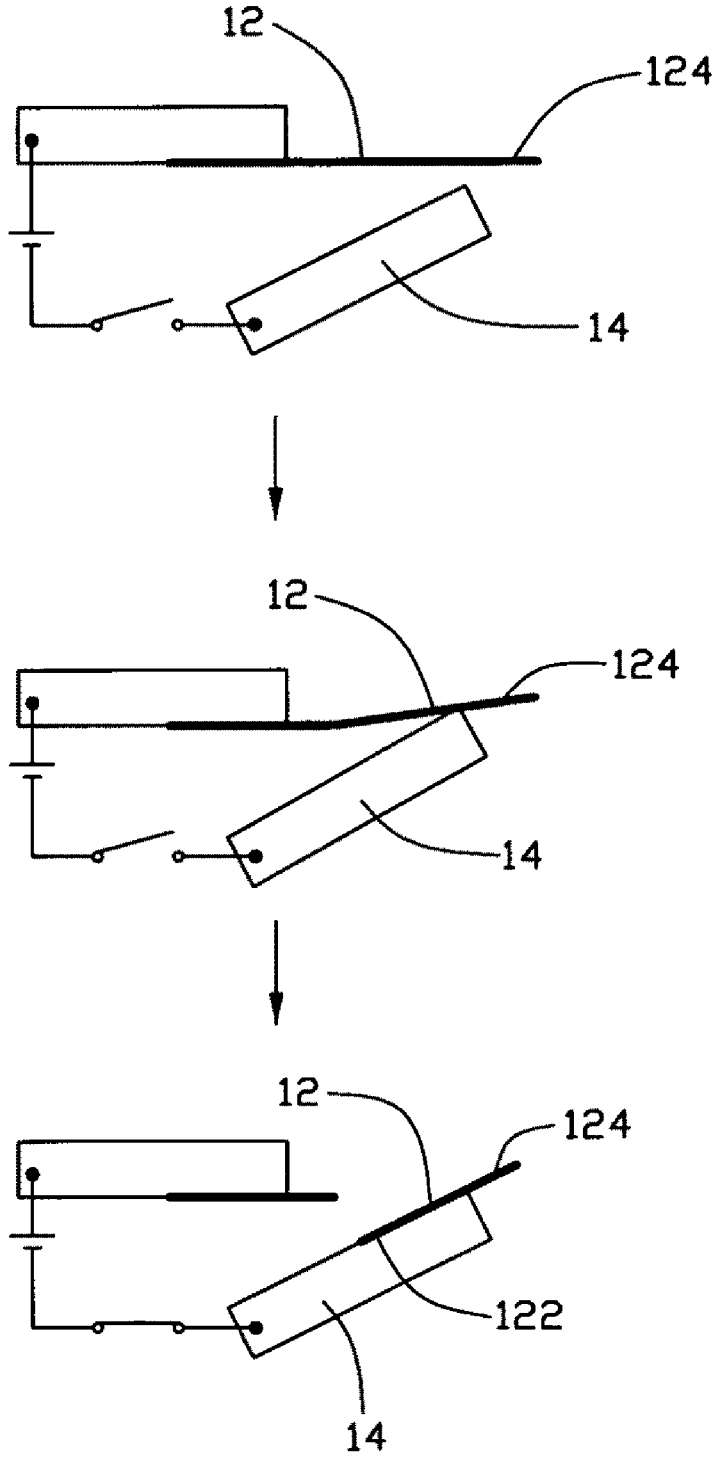
FIG. 12 is a flow chart of a method for attaching the carbon nanotube needle to the conductive base.

Referring to FIG. 12, Step (e) includes the following sub-steps: (e1) fixing the conductive base 14 on a three-DOF translational machine; (e2) moving the conductive base 14 with the three-DOF translational machine to contact the end portion 122 of the CNT needle 12, bending the CNT needle 12, forming an inflexion in the CNT needle 12; and (e3) supplying a voltage between the CNT needle 12 and the conductive base 14 to heat the CNT needle 12, the CNT needle 12 snaps at the inflexion and breaks away from the electrode, subsequently sticking on the conductive base 14.

In step (e1), the three-DOF translational machine can move accurately in the three-DOF, and as a result, the conductive base 14 can move accurately in the three-DOF.

Step (e2) is executed under a microscope to observe and control the distance between the CNT needle 12 and the conductive base 14 more acutely.

After the CNT needle 12 is attached to the conductive base 14, the field emission electron source 10 is formed. The conductive base 14 is made of an electrically conductive material, such as nickel, copper, tungsten, gold, molybdenum or platinum. The conductive base 14 is an insulated base with a conductive film formed thereon. The size of the CNT needle 12 is so tiny that the CNT needle 12 will be destroyed when a mechanical tool is used to cut the CNT needle 12 directly.

Figure 13:
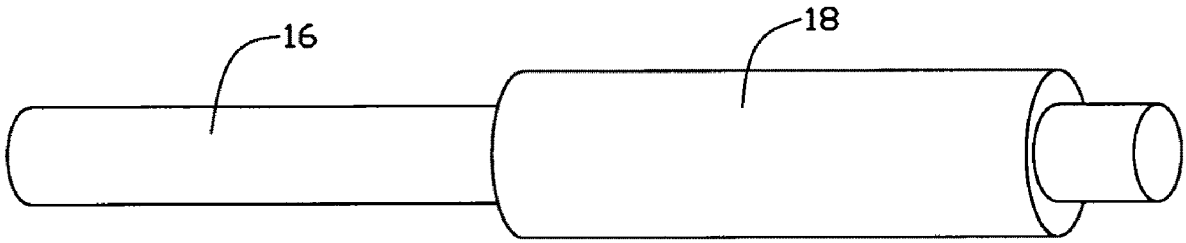
FIG. 13 is a schematic, cross-sectional view, showing an optical fiber with conductive adhesive thereon.
Figure 14:
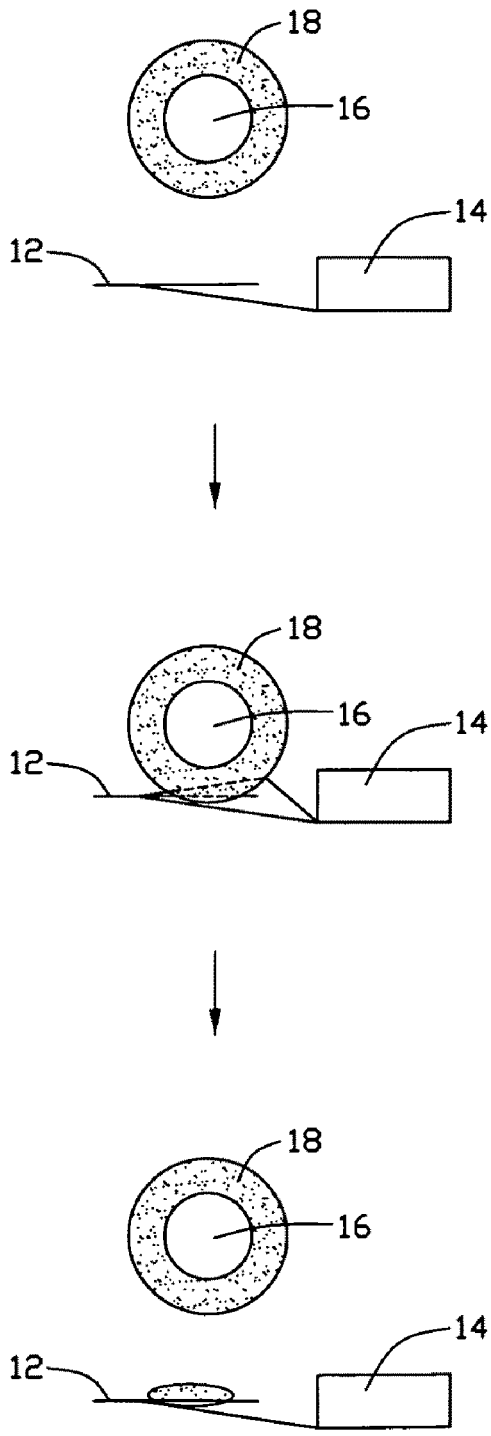
FIG. 14 is a flow chart of a method for fixing the carbon nanotube needle on the conductive base with a conductive adhesive.

Referring to FIGS. 13 and 14, the method for manufacturing the field emission electron source can optionally include a step (f). Step (f) includes the following sub-steps: (f1) providing a support and a coating layer of conductive adhesive 18 on one end of the support 16; (f2) fixing the other end of the support 16 on a three-DOF translational machine; (f3) moving the support 16 to the field emission electron source 10, adhering the conductive adhesive 14 to the joint of the CNT needle 12 and the conductive base 14; and (f4) drying conductive adhesive 18 on the field emission electron source 10.

In step (f1), the support 16 is a linear structure, a diameter thereof approximately ranges from 50 μm to 200 μm. A thickness of the conductive adhesive 18 approximately ranges from 5 μm to 50 μm. In the present embodiment, the support 16 is a fiber, a diameter of the fiber is 125 μm, a thickness of the lay of conductive adhesive 18 is 125 μm, and the conductive adhesive 18 is a silver paste.

Step (f3) is operated under the microscope. Since the conductive adhesive 14 is a silver paste, and part of the field emission source 10 enters the layer of conductive adhesive, the conductive adhesive 18 is adhered to the joint of the CNT needle 12 and the conductive base 14 when the field emission electron source 10 is moved slowly. As there is intermolecular force between the CNT needle 12 and the conductive base 14, the CNT needle 12 will not depart from the conductive base 14.

Figure 15:
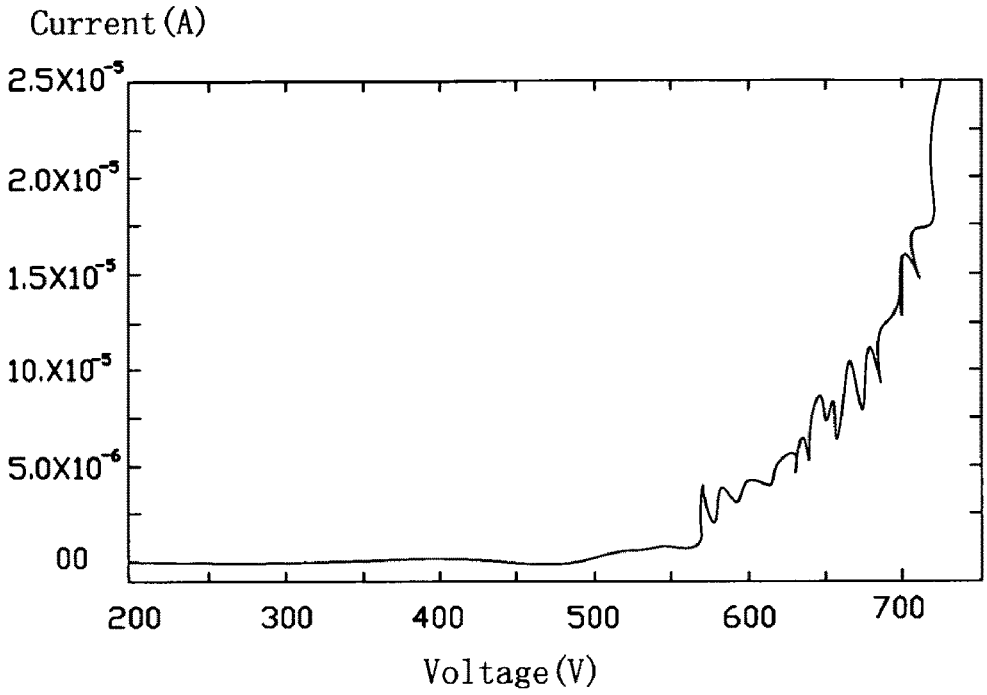
FIG. 15 is a current-voltage graph of the field emission electron source manufactured by the present method.

In step (f4), the organic component in the conductive adhesive 18 is removed, and the conductive adhesive 18 becomes solid, the CNT needle 12 is firmly fixed on the conductive base 14. FIG. 15 shows an I-V graph of the present field emission electron source 10. A threshold voltage thereof is about 500 V while an emission current thereof is over 25 μA. A diameter of the break-end portion is about 5 μm and, thus, a current density is calculated over 100 $A/cm^2$.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that above description and the claims drawn to a method may include some indication in reference to certain steps. However, the indication used is only to be viewed for identification purposes and not as a suggestion as to an order for the steps.

What is claimed is:

1. A method for manufacturing a field emission electron source, the method comprising the steps of:

(a) providing a carbon nanotube (CNT) film comprising of a plurality of CNTs, the CNTs being aligned along a same direction, a first electrode, and a second electrode;

(b) fixing the two opposite sides of the CNT film on the first electrode and the second electrode, the CNTs in the CNT film extending from the first electrode to the second electrode;

(c) treating the CNT film with an organic solvent to form at least one CNT string;

(d) applying a voltage between two opposite ends of the at least one CNT string until the at least one CNT string snaps, thereby obtaining at least one CNT needle, wherein the at least one CNT needle has an end portion and a broken end portion; and (e) securing the at least one CNT needle to a conductive base by attaching the end portion of the at least one CNT needle to the conductive base; and wherein the broken end portion has a single tip CNT protruding from the broken end portion.

2. The method as claimed in claim 1, wherein in step (a), the CNT film is formed by the substeps of:

(a1) providing an array of CNTs; and (a2) drawing a CNT segment from the array of CNTs via a pulling tool to form the CNT film.

3. The method as claimed in claim 1, wherein in step (c), the organic solvent is a volatile organic solvent, the organic solvent is selected from a group consisting of ethanol, methanol, acetone, dichloroethane, and chloroform.

4. The method as claimed in claim 1, wherein step (c) further comprises the sub steps of: putting the organic solvent onto the CNT film or putting the CNT film with the first electrode and the second electrode in the organic solvent to soak the entire surfaces of the carbon nanotube film.

5. The method as claimed in claim 1, wherein in step (e), a material of the conductive base is selected from a group consisting of copper, tungsten, gold, molybdenum and platinum.

6. The method as claimed in claim 1, wherein in step (e), the conductive base is an insulated base with a conductive film formed thereon.

7. The method as claimed in claim 1, wherein a distance between the first electrode and the second electrode approximately ranges from 50 micrometers to 2 millimeters.

8. The method as claimed in claim 1, wherein step (d) further comprises the sub steps of:

(d1) placing the at least one CNT string, the first electrode and the second electrode in a chamber; and (d2) applying a voltage between two opposite ends of the at least one CNT strings via the first electrode and the second electrode for a period of time to snap the at least one CNT string, thereby acquiring at least one CNT needle with a break-end.

9. The method as claimed in claim 8, wherein in step (d), wherein CNT string can reaches a temperature ranging approximately from 2000 to 2400 kelvins before snapping.

10. The method as claimed in claim 1, wherein step (e) further comprises the substeps of:

(e1) fixing the conductive base on a three-DOF translational machine;

(e2) moving the conductive base with the three-DOF translational machine to contact the end portion of one CNT needle and form an inflexion in the CNT needle; and (e3) supplying a voltage between the CNT needle and the conductive base to heat the CNT needle, snapping at the inflexion and the CNT needle sticking on the conductive base.

11. The method as claimed in claim 1, wherein a step (f) is further provided after step (e), step (f) comprising the substeps of:

(f1) further providing a support, and a coating layer of conductive adhesive on one end of the support;

(f2) fixing the other end of the support on a three-DOF translational machine;

(f3) moving the support to the field emission electron source, adhering the conductive adhesive to a joint of the CNT needle and the conductive base; and (f4) drying the conductive adhesive on the field emission electron source.

12. The method as claimed in claim 11, wherein step (f3) is executed by drying the conductive adhesive temperature approximately ranging from 80° C. to 120° C., and then sintering the conductive adhesive in a temperature of 350° C. to 500° C. for 20 minutes to 1 hour.

13. The method as claimed in claim 11, wherein the conductive adhesive is a silver paste.

14. A method for manufacturing a carbon nanotube needle, the method comprising the steps of:

(a) providing a carbon nanotube (CNT) film comprising a plurality of CNTs, a first electrode; and a second electrode;

(b) fixing the two opposite sides of the CNT film on the first electrode and the second electrode, and treating the CNT film with an organic solvent to form at least one CNT string;

(c) applying a voltage between two opposite ends of the at least one CNT string until the at least one CNT string snaps, thereby obtaining at least one CNT needle.

15. The method as claimed in claim 14, wherein step (c) further comprises the sub steps of:

(c1) placing the at least one CNT string, the first electrode and the second electrode in a chamber; and (c2) applying a voltage between two opposite ends of the at least one CNT string via the first electrode and the second electrode for a period of time to snap the at least one CNT string.

16. The method as claimed in claim 15, wherein in step (d), wherein the at least one CNT string reaches a temperature ranging approximately from 2000 to 2400 kelvins before snapping.

17. The method as claimed in claim 14, further comprising a step (e) of securing the at least one CNT needle to a conductive base by attaching an end portion of the at least one CNT needle to the conductive base, wherein step (e) further comprises the substeps of:

(e1) fixing the conductive base on a three-DOF translational machine;

(e2) moving the conductive base with the three-DOF translational machine to contact the end portion of the at least one CNT needle and form an inflexion in the at least one CNT needle; and (e3) supplying a voltage between the at least one CNT needle and the conductive base to heat the at least one CNT needle, snapping at the inflexion, and the at least one CNT needle sticking on the conductive base.

18. The method as claimed in claim 17, further comprising a step (f) after step (e), step (f) comprising the substeps of:

(f1) providing a support and a coating layer of conductive adhesive on one end of the support;

(f2) fixing the other end of the support on the three-DOF translational machine;

(f3) moving the support to the field emission electron source, adhering the conductive adhesive to a joint of the at least one CNT needle and the conductive base; and (f4) drying the conductive adhesive on the field emission electron source.

19. The method as claimed in claim 18, wherein step (f3) is executed by drying the conductive adhesive at a temperature approximately ranging from 80° C. to 120° C., and then sintering the conductive adhesive in a temperature of 350° C. to 500° C. for 20 minutes to 1 hour.

20. The method as claimed in claim 18, wherein the conductive adhesive is a silver paste.

* * * * *